US010825639B2

(12) United States Patent
Koschmieder et al.

(10) Patent No.: US 10,825,639 B2
(45) Date of Patent: Nov. 3, 2020

(54) X RAY DEVICE FOR CREATION OF HIGH-ENERGY X RAY RADIATION

(71) Applicant: Siemens Healthcare GmbH, Erlangen (DE)

(72) Inventors: Martin Koschmieder, Uhlstaedt-Kirchhasel (DE); Marvin Moeller, Jena (DE); Sven Mueller, Urbich (DE); Stefan Willing, Rudolstadt (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 326 days.

(21) Appl. No.: 15/947,934

(22) Filed: Apr. 9, 2018

(65) Prior Publication Data

US 2018/0294134 A1 Oct. 11, 2018

(30) Foreign Application Priority Data

Apr. 11, 2017 (EP) ..... 17165888

(51) Int. Cl.
*H01J 35/12* (2006.01)
*G21K 1/02* (2006.01)
(Continued)

(52) U.S. Cl.
CPC ..... *H01J 35/12* (2013.01); *G21K 1/02* (2013.01); *H01J 35/00* (2013.01); *H05H 6/00* (2013.01);
(Continued)

(58) Field of Classification Search
CPC ..... G21K 1/02; G21K 1/10; H01J 2235/08; H01J 2235/1262; H01J 35/00; H01J 35/12; H05H 6/00; H05H 9/048
See application file for complete search history.

(56) References Cited

U.S. PATENT DOCUMENTS 3,969,629 A * 7/1976 McIntyre ..... A61N 5/10 378/65
3,988,153 A * 10/1976 Politycki ..... H01J 9/14 430/321
(Continued)

FOREIGN PATENT DOCUMENTS

CN 105140088 A 12/2015
DE 102012103974 A1 6/2013
(Continued)

OTHER PUBLICATIONS

Anonymous: "Composition of Copper"; XP055414377, Gefunden im Internet: URL:https://physics.nist.gov/cgi-bin/Star/compos.pl?029; 2017.
(Continued)

*Primary Examiner* — Dani Fox
*Assistant Examiner* — Soorena Kefayati
(74) *Attorney, Agent, or Firm* — Harness, Dickey & Pierce, P.L.C.

(57) ABSTRACT

An x-ray device is for creation of high-energy x-ray radiation. In an embodiment, the x-ray device includes a linear accelerator. The linear accelerator, for creation of x-ray radiation, is embodied so as to create an electron beam directed onto a target, of which the kinetic energy per electron amounts to at least 1 MeV. In an embodiment, the x-ray device further includes a beam limiting device, arranged in the beam path of the electron beam between linear accelerator and the target, including an edge region surrounding a beam limiting device opening. A material thickness of the edge region, in a propagation direction of the accelerated electron beam emerging from the linear accelerator, amounting to less than 10% of the average reach of electrons of the created kinetic energy in the material of the edge region.

21 Claims, 3 Drawing Sheets

(51) Int. Cl.

| | |
|---|---|
| ***H01J 35/00*** | (2006.01) |
| ***H05H 6/00*** | (2006.01) |
| ***G21K 1/10*** | (2006.01) |
| ***H05H 9/04*** | (2006.01) |

(52) U.S. Cl.
CPC ..... *G21K 1/10* (2013.01); *H01J 2235/08* (2013.01); *H01J 2235/1262* (2013.01); *H05H 9/048* (2013.01)

(56) References Cited

U.S. PATENT DOCUMENTS 4,121,109 A * 10/1978 Taumann ..... G21K 1/02 378/156
4,140,129 A * 2/1979 Heinz ..... G21K 1/04 250/505.1
4,157,475 A * 6/1979 Stock ..... A61N 5/10 250/397
4,327,293 A * 4/1982 Taumann ..... G21K 1/02 378/147
4,359,642 A * 11/1982 Heinz ..... G21K 1/02 250/505.1
4,467,197 A * 8/1984 Stieber ..... G01T 1/29 250/305
4,812,653 A * 3/1989 Comey ..... G01J 5/06 250/338.1
4,952,814 A * 8/1990 Huntzinger ..... G21K 1/10 250/492.3
5,033,075 A * 7/1991 DeMone ..... G21K 1/10 378/156
5,059,802 A * 10/1991 Filthuth ..... G21K 1/02 250/328
5,317,618 A * 5/1994 Nakahara ..... B01J 19/125 252/587
6,320,936 B1 * 11/2001 Holland, Sr. ..... G21K 1/02 378/140
6,333,966 B1 * 12/2001 Schoen ..... G21K 1/003 378/119
6,509,127 B1 * 1/2003 Yamashita ..... B82Y 10/00 430/296
6,864,633 B2 * 3/2005 Trail ..... H05H 9/04 315/5.41
7,091,486 B1 * 8/2006 McCord ..... H01J 37/09 250/311
2002/0064253 A1 * 5/2002 Gutman ..... H05G 2/00 378/84
2005/0213711 A1 * 9/2005 Ukita ..... H01J 35/12 378/141
2007/0170375 A1 * 7/2007 Tang ..... H05G 2/00 250/493.1
2007/0252093 A1 * 11/2007 Fujimaki ..... A61N 5/1048 250/492.3
2010/0040198 A1 * 2/2010 Comer ..... G21K 1/10 378/65
2010/0201240 A1 * 8/2010 Heinke ..... H05H 9/00 313/35
2011/0017920 A1 * 1/2011 Goer ..... A61N 5/10 250/396 R
2011/0026680 A1 * 2/2011 Sato ..... H01J 35/06 378/119
2011/0058655 A1 3/2011 Okumura et al.
2011/0114838 A1 * 5/2011 Han ..... G01B 15/00 250/307
2011/0142202 A1 * 6/2011 Brown ..... A61N 5/1049 378/65
2012/0292538 A1 * 11/2012 Anton ..... A61N 5/1077 250/515.1
2013/0221243 A1 * 8/2013 Perkins ..... A61N 5/1042 250/492.3
2014/0064447 A1 * 3/2014 Ogura ..... H01J 35/16 378/62
2014/0177807 A1 * 6/2014 Lewellen ..... A61B 6/06 378/124
2018/0005721 A1 1/2018 Miyaoka
2018/0342330 A1 * 11/2018 Schu ..... H01J 35/14
2020/0035440 A1 * 1/2020 Yun ..... H01J 35/30

FOREIGN PATENT DOCUMENTS

GB 665998 A * 2/1952 ..... H05H 9/02
GB 665998 A 2/1952
JP 2011077027 A 4/2011
WO WO 2011062810 A2 5/2011
WO WO 2016125289 A1 8/2016

OTHER PUBLICATIONS

Anonymous: "Stopping Power and Range Tables for Electrons"; XP055414376, Gefunden im Internet: URL:https://physics.nist.gov/cgi-bin/Star/e table.pl; 2017.
German Office Action dated Oct. 18, 2017 for Application No. EP17165888.3-1556.

* cited by examiner

X RAY DEVICE FOR CREATION OF HIGH-ENERGY X RAY RADIATION

PRIORITY STATEMENT

The present application hereby claims priority under 35 U.S.C. § 119 to European patent application number EP17165888.3 filed Apr. 11, 2017, the entire contents of which are hereby incorporated herein by reference.

FIELD

At least one embodiment of the invention generally relates to an x-ray device for creation of high-energy x-ray radiation, comprising a linear accelerator and a target. In at least one embodiment, the linear accelerator is embodied for creation of x-ray radiation so as to create an electron beam directed onto the target, of which the kinetic energy per electron amounts to at least 1 MeV.

BACKGROUND

X-ray devices typically have an electron beam source, which provides an accelerated electron beam to be applied to a target (also: target material). When the electrons strike the target x-ray, radiation arises in the region of the so-called focal spot. The electron beam source is usually formed by a cathode, wherein the electrons emerging are accelerated by the presence of an acceleration field strength in the direction of an anode, which in such versions forms the target. In high-energy applications it is further known that a linear accelerator, which provides an electron beam directed onto the target, can be used as an electron beam source.

In many applications of radioscopy or radiology the need exists to create a focal spot that is as small as possible. In imaging this enables a high spatial resolution to be achieved with optical enlargement for example or enables the half shadows caused by the beam limiting devices limiting the x-ray radiation field to be reduced. During radiation therapy, in particular during intensity-modulated radiation therapy, a more precise dose distribution of the deposited x-ray radiation can furthermore be realized in this way.

An x-ray tube for medical imaging such as computed tomography is known from DE 10 2012 103974 A1, which comprises a cathode and an anode. The electron beam is directed onto a target for creation of x-ray radiation. To limit the focal spot size on the target the electron beam passes through a beam limiting device channel, which is inserted into a beam limiting device body, limiting said beam laterally. To enable heat arising during the absorption of the electrons to be dissipated, the region around the beam limiting device channel must be designed so as to be as massive as possible, where necessary water cooling is provided in addition.

SUMMARY

At least one embodiment of the present invention specifies an x-ray device for creation of high-energy x-ray radiation, with which the extent of the focal spot on the target can be minimized.

In accordance with at least one embodiment of the invention, an x-ray device is for creation of high-energy x-ray radiation.

Advantageous embodiments of the invention are the subject matter of the claims.

An x-ray device of at least one embodiment, for creation of high-energy x-ray radiation, comprises a linear accelerator and a target. The target typically includes a target material, which is used for creation of x-ray radiation by decelerating the accelerated electrons. The region of the target in which this conversion takes place is referred to as the focal spot. The linear accelerator is further embodied and configured to create an electron beam directed onto the target, of which the kinetic energy per electron amounts to at least 1 MeV.

In accordance with at least one embodiment of the invention, a beam limiting device is arranged in the beam path of the electron beam between the linear accelerator and the target, which has an edge region surrounding a beam limiting device opening, of which the material thickness in the propagation direction of the electron beam amounts to less than 10% of the average reach of electrons of the created kinetic energy in the material of the edge region.

At least one embodiment of the invention further relates to a method for manufacturing an x-ray device for creation of high-energy x-ray radiation, in particular to a method for manufacturing one of the x-ray devices described above. The x-ray device comprises a linear accelerator and a target, wherein the linear accelerator is embodied for creation of x-ray radiation so as to create an electron beam directed onto the target, of which the kinetic energy per electron amounts to at least 1 MeV.

In accordance with at least one embodiment of the invention, a component is arranged in the beam path of the electron beam between linear accelerator and target, of which the material thickness in the propagation direction of the electron beam amounts to less than 10% of the average reach of electrons of the created kinetic energy in the material of the component. A beam limiting device opening is inserted into the component by the component having an electron beam created by the linear accelerator applied to it. In this sense the component, after insertion of the beam limiting device opening, forms the beam limiting device already described.

BRIEF DESCRIPTION OF THE DRAWINGS

For a further description of the invention the reader is referred to the example embodiments shown in the figures of the drawing. In the figures, in a schematic diagram in each case.

Parts or reference values that correspond to one another are labeled in all figures with the same reference characters.

DETAILED DESCRIPTION OF THE EXAMPLE EMBODIMENTS

Figure 1:
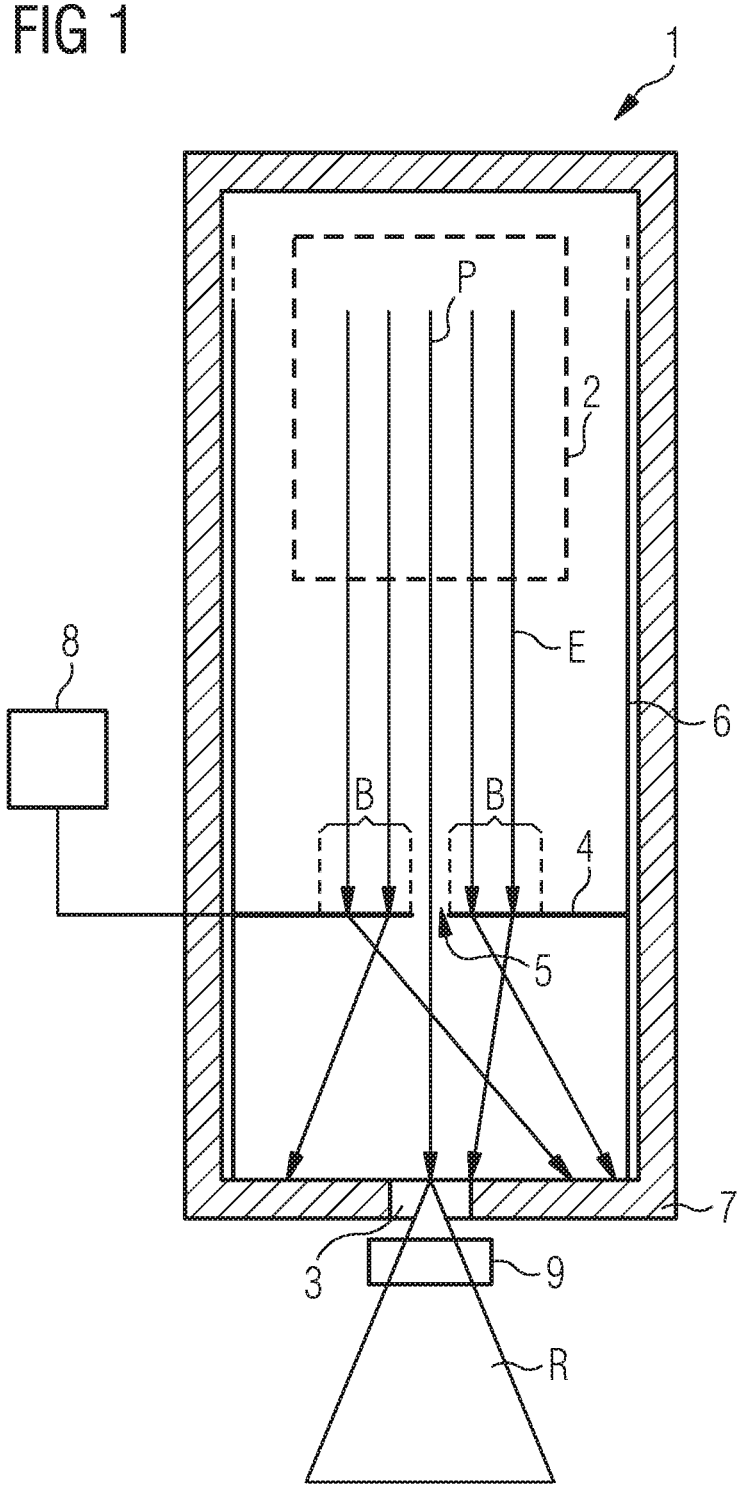
FIG. 1: shows an x-ray device according to a first example embodiment in a schematic cross-sectional diagram.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

An x-ray device of at least one embodiment, for creation of high-energy x-ray radiation, comprises a linear accelerator and a target. The target typically includes a target material, which is used for creation of x-ray radiation by decelerating the accelerated electrons. The region of the target in which this conversion takes place is referred to as the focal spot. The linear accelerator is further embodied and configured to create an electron beam directed onto the target, of which the kinetic energy per electron amounts to at least 1 MeV.

In accordance with at least one embodiment of the invention, a beam limiting device is arranged in the beam path of the electron beam between the linear accelerator and the target, which has an edge region surrounding a beam limiting device opening, of which the material thickness in the propagation direction of the electron beam amounts to less than 10% of the average reach of electrons of the created kinetic energy in the material of the edge region.

High kinetic energies are typically achieved in linear accelerators, so that the emitted electrons, by comparison with the electrons created in conventional x-ray tubes, have an increased average reach in materials. For restricting the focal spot in this energetic region the invention chooses the approach of providing a beam limiting device, which is not embodied to absorb the electrons of the created energy range to a significant extent, but rather there is provision for the interaction to be essentially restricted to inelastic or elastic scattering processes. To this end the beam limiting device, at least in the edge region delimiting the beam limiting device opening, has a material thickness that merely amounts to a fraction of the average reach of electrons of the created kinetic energy in the material of the edge region.

In the transmission of the electron beam by the edge region of the beam limiting device the peripheral electrons, which penetrate the edge region, undergo a deflection and are scattered. The subsequently divergently propagating electrons then generally do not strike the target material, which forms the target. The region of the electron beam creating the focal spot is thus essentially limited to the region of the beam limiting device opening. At the same time the energy transmission to the beam limiting device is minimal, since said device is based essentially on inelastic scatter effects. Inter alia this means that there is a smaller input of heat to the beam limiting device, which therefore does not necessarily have to be additionally cooled.

In other words the edge region of the beam limiting device forms a scattering body (also: diffuser) for the electrons passing through it of the energy range predetermined by the available acceleration voltage. The electrons deflected at random in this case can be absorbed in other regions of the x-ray device and are thus no longer visible in the useful radiation field of the created x-ray radiation. Inter alia the restriction of the focal spot on the target (also: target material) causes an improved image quality in imaging methods. Thus the acquired images exhibit a lower unsharpness or smaller half shadows, since the extent of the focal spot approaches an ideal point source.

Possible fields of application relate for example to radioscopy, in particular the non-destructive testing of work pieces, components or other objects, the checking of transported freight, in particular as part of freight goods checking, in which for example trucks or freight containers for trains or container ships are x-rayed, in order to make their contents visible, or applications in the area of medicine, in particular in the area of radiation therapy. Thus for example, through the restriction of the focal spot provided by the invention, a more precise dose distribution can be realized in radiation therapy, in particular in intensity-modulated radiation therapy, since the half shadows of the collimator restricting the useful photon radiation field are smaller. Moreover the x-ray devices can be optimized in respect of their weight, since downstream collimators for collimation of the created x-ray radiation are omitted or can at least be limited.

The acceleration concept of the linear accelerator can be based for example in a known manner on the formation of standing electromagnetic waves or of electromagnetic traveling waves within an acceleration structure of the linear accelerator. The acceleration structure, in a manner known per se, comprises a hollow space resonator structure in particular having a number of chambers, which is designed to form an accelerated electron beam by application of suitable electromagnetic fields. The chambers of the hollow space resonator structure are separated from one another for example by diaphragms, which have central openings. The aforementioned accelerated electron beam relates to the electron beam after it has passed through the acceleration voltage transmitted by the acceleration structure, i.e. after it has exited from the linear accelerator.

The beam limiting device consists in a simple example embodiment of a thin sheet of metal, especially of steel or another transition metal or alloy. A further, especially preferred non-metallic material for the beam limiting device is graphite for example.

It goes without saying that the material and the material thickness of the beam limiting device, at least in the edge region surrounding the beam limiting device opening, is tailored to the kinetic energy of the electrons created when the x-ray device is used according to specification. With kinetic energies in the MeV range the material thickness typically lies in the region of one or more millimeters, if this includes a lightweight material such as graphite for example. Beam limiting devices made from a heavier material, in particular metal, have a lower material thickness in the submillimeter range for example, in particular in the region von around 1/10 mm.

In an example embodiment of the invention, at least the edge region of the beam limiting device scattering the electrons is formed by a film or by a number of films. Such versions are to be seen as low-cost implementations of a scatter body of sufficiently small thickness, in which it is insured that the interaction with the electrons of the created kinetic energy is essentially restricted to scattering processes. If the region of beam limiting device, which is the cause of the scattering of the electrons, is formed by a film material of this type, then the heat input is minimal. The beam limiting devices embodied in this way do not therefore necessarily have to be cooled actively during the operation of the x-ray device.

The film preferably includes a metal. Especially preferably the beam limiting device or at least the scattering edge region of the beam limiting device includes titanium. In other example embodiments the beam limiting device or at least the edge region surrounding the beam limiting device opening includes stainless steel, tungsten or copper or of another transition metal or transition metal alloy.

The beam limiting device, in particular the beam limiting device described here consisting of at least one metallic film, is able to be cooled in a possible example embodiment via a cooling device, in particular via a water cooling device. This insures that even the relatively small heat transfer transmitted by inelastic scatter processes can be dissipated reliably.

Preferably a collimator is arranged in the beam path of the x-rays created by the irradiation of the target. This serves to restrict the useful radiation field of the created x-ray radiation. If the location where the x-ray radiation arises (focal spot) is small, then the half shadows at the boundaries of the useful radiation field are also small.

Especially preferably, a vacuum housing at least surrounding the linear accelerator, the beam limiting device and the target or a vacuum envelope surrounding these components is provided with screening, which is suitable for absorbing x-ray radiation, which is produced by scattered electrons, which strike the vacuum housing and are decelerated by it. The choice of walling material can be spectrally influenced by the x-ray radiation arising in such cases and is preferably to be screened locally by screening arranged outside the vacuum housing.

In other example embodiments, the screening is provided inside the vacuum housing. Since the vacuum housing of the x-ray device is evacuated, the screening provided inside the vacuum housing preferably includes a material with high vapor pressure, especially preferably the screening comprises elements with a small atomic charge. Materials that have a low vapor pressure can also be used on the outside of the vacuum housing for screening. This screening consists wholly or in part of lead for example. Since the scattered electrons are not absorbed by the material of the beam limiting device, these spread out divergently from the propagation direction of the electron beam and strike the vacuum housing provided with the screening materials, by which they are absorbed. Since the absorption of the electrons scattered at the beam limiting device does not take place in a heavily localized region, but over large surface areas of the vacuum housing, external cooling can in general also be dispensed with here.

In other possible embodiments of the invention, the vacuum housing of the x-ray device is able to be cooled via fluid cooling.

Especially preferably the regions provided with the screening, compared to regions of the vacuum housing without screening, have an increased absorption for electrons of the created kinetic energy. In other words there is provision to furnish just those regions with screening that are relevant for the absorption of scattered electrons. Inter alia this contributes to weight reduction.

The regions provided with the screening preferably lie exclusively within a solid angle area emanating from the beam limiting device, extending in the propagation direction of the electron beam. The solid angle region is preferably formed by a plurality of superimposed scatter cones, of which the tips lie within the edge region surrounding the beam limiting device opening. In other words the screening is arranged where the electrons scattered in the edge region of the beam limiting device are at least highly likely to occur.

In a development of at least one embodiment of the invention, there is provision for the screening solid angle region to correspond to an average solid angle region of the electrons scattered in the edge region of the beam limiting device. This development makes use of the observation that the average scatter angle depends both on the kinetic energy of the incident electrons and also on the scatter body, which is provided here by the edge region surrounding the beam limiting device opening. Depending on the acceleration voltage applied during operation and the scatter material used for delimitation of the focal spot, it is thus made possible to provide a selective dimensioning of the screening. This especially makes a further weight reduction possible, since only those regions of the vacuum housing in which the majority of the scattered electrons will be absorbed are provided with screening.

Thus, for example, the deflection of the scattered electrons in relation to the propagation direction of the non-scattered electrons is smaller at higher energies than with electrons of lower kinetic energy. As a result, with x-ray devices that are embodied to provide higher-energy x-ray radiation, the screening can therefore be restricted to a smaller concentrated solid angle region around the propagation direction of the non-scattered electron beam.

An average solid angle region in the sense of the present specification is assumed to be a scatter cone centered around the average scatter angle, of which the opening angle corresponds to an average deviation characteristic for the scatter process, in particular a standard deviation. The average scatter angle designates the average value of the angle of the scattered electrons in relation to the axis of acceleration, which matches the propagation direction of the unscattered electrons.

The linear accelerator of the x-ray device is preferably embodied to create an electron beam, of which the kinetic energy per electron amounts to less than 20 MeV. The x-ray device is thus preferably able to be used for the already described applications in the area of radioscopy or radiology.

At least one embodiment of the invention further relates to a method for manufacturing an x-ray device for creation of high-energy x-ray radiation, in particular to a method for manufacturing one of the x-ray devices described above. The x-ray device comprises a linear accelerator and a target, wherein the linear accelerator is embodied for creation of x-ray radiation so as to create an electron beam directed onto the target, of which the kinetic energy per electron amounts to at least 1 MeV.

In accordance with at least one embodiment of the invention, a component is arranged in the beam path of the electron beam between linear accelerator and target, of which the material thickness in the propagation direction of the electron beam amounts to less than 10% of the average reach of electrons of the created kinetic energy in the material of the component. A beam limiting device opening is inserted into the component by the component having an electron beam created by the linear accelerator applied to it. In this sense the component, after insertion of the beam limiting device opening, forms the beam limiting device already described.

It has been shown that the electron beams created via linear accelerators are already sharply focused as a result of the electric fields present, so that the particle density in the center of the electron beam is greatly increased. The invention also makes use of this characteristic to insert the beam limiting device opening described above into the component. To this end the current strength of the accelerated electron beam that may be provided by the linear accelerator is increased compared to the current strength generated in normal operation, in order to burn a hole into the component inserted into the beam path—which is formed for example by one or more of the films described above. The dimensioning of the beam limiting device opening created in this way corresponds in this case to the central region of the electron beam and thus automatically to a beam limiting device opening with the scatter characteristic described above for the electrons propagating outside the central region. The effort of an adjustment of a beam limiting device already having a beam limiting device opening can be avoided and thus installation and adjustment costs can be saved.

FIG. 1 shows an x-ray device 1 in accordance with a first example embodiment of the invention in a schematic cross-sectional diagram. The x-ray device 1 comprises a linear accelerator 2, merely shown schematically, which is designed to create an electron beam E of the kinetic energy of at least 1 MeV per electron. The electron beam E is directed onto a target 3. The target 3 emits x-ray radiation R in the region of a focal spot.

Arranged in the beam path between linear accelerator 2 and target 3 is a beam limiting device 4, which diffusely scatters a peripheral part of the incident primary electron beam E, so that the extent of the focal spot on the target 3 is reduced. For this purpose at least one edge region B of the beam limiting device 4 surrounding a beam limiting device opening 5 includes a material that is suitable for scattering electrons of the created kinetic energy. The edge region B of the beam limiting device 4, in the propagation direction P of the electron beam E, has a material thickness that is small by comparison with the reach of the electrons of the created kinetic energy in the material of the edge region B. In concrete terms the material thickness of the edge region B in the example embodiment considered here amounts to less than around 10% of the reach of electrons with the kinetic energy of 1 MeV in the material of the edge region B.

The electrons propagating outside of the center of the electron beam E are scattered diffusely by the edge region B and thus distributed over a large surface area over the inner surface of a vacuum housing 6 of the x-ray device 1. Accordingly the heat input caused by the absorption of these electrons is also distributed over wide regions of the vacuum housing 6, so that an external cooling of the vacuum housing 6 can be dispensed with.

Arranged on the outside of the vacuum housing 6 is screening 7, which in the example embodiment includes lead and extends—with the exception of the region of the target 3 —over the entire outer surface of the vacuum housing 6.

The fact that the lateral edge areas of the electron beam E are scattered away from the target 3 enables half shadows in images recorded by the created x-ray radiation R to be minimized. Radioscopy thus presents itself as an area of application for the x-ray device 1, other fields of application relate to medical radiation therapy for example.

The beam limiting device 4, in the example embodiment shown, is formed by a simple sheet or metal or by a film made of metal. Since the interaction of the electrons with the material of the beam limiting device 4 is essentially restricted to inelastic and elastic scatter events, the input of heat is also minimal here. A cooling of the beam limiting device 4 is thus not absolutely necessary.

A cooling device 8 for fluid cooling of the beam limiting device 4 is provided as an option, which is shown schematically in FIG. 1. In this case the beam limiting device 4 is designed such that a cooling fluid, for example water, can be carried through at least a section of the beam limiting device. In one possible example embodiment the beam limiting device 4 is formed by two plane-parallel films, between which a space is formed, into which the cooling fluid is able to be introduced.

The proportion of the x-ray radiation R caused by scattered electrons can be further reduced if a there is a collimation of the x-ray radiation R emanating from the target 3. To this end a collimator 9, for example a multileaf collimator, is optionally arranged in the area close to the target of the emerging x-ray radiation R.

Figure 2:
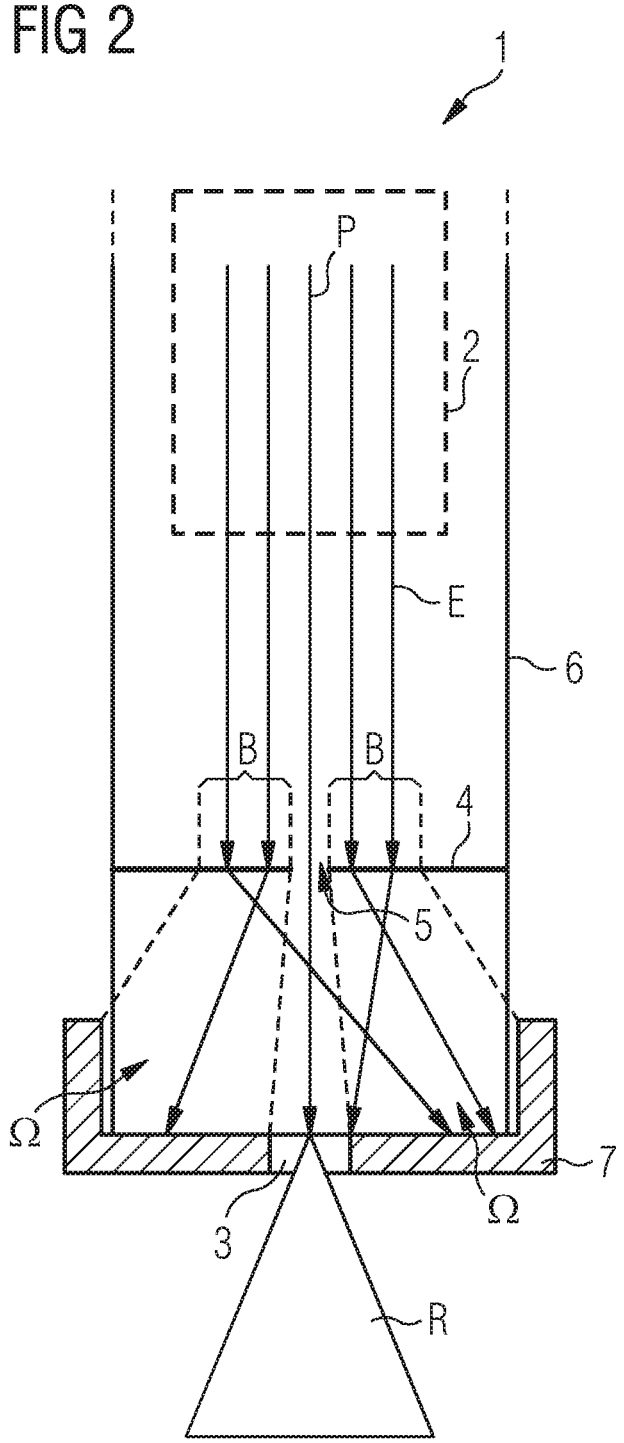
FIG. 2: shows an x-ray device according to a second example embodiment in a schematic cross-sectional diagram.

FIG. 2 shows an x-ray device 1 in accordance with a second example embodiment. The example embodiment differs from the version illustrated in FIG. 1 only in respect of the extent of the screening 7, so that the reader is first referred to the description relating to said figure in order to avoid repetitions.

In the second example embodiment shown in FIG. 2 the screening 7 is restricted to a part area of the vacuum housing 6. The screening 7 is designed such that at least the overwhelming proportion of the electrons scattered in the edge region B will be absorbed by the screening 7. To this end a solid angle region Ω emanating from the scattering edge region B (indicated by cross-hatched lines in the figure) is to be screened, into which on average the great majority of electrons will be scattered. The extent of the screening 7 is thus to be designed as a function of the kinetic energy of the electrons in accordance with the average scatter angle Φ and the average deviation from this average scatter angle Φ.

Figure 3:
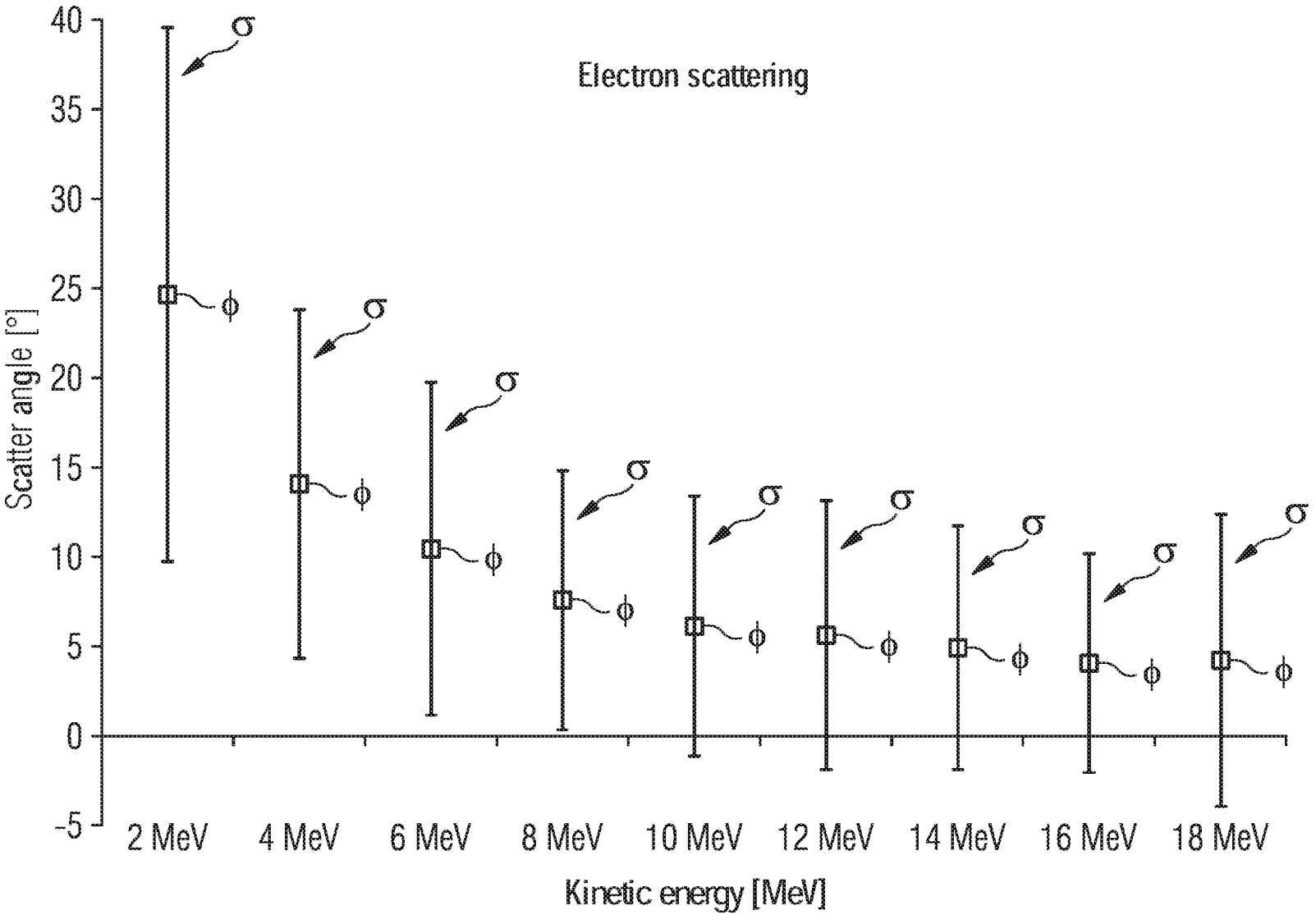
FIG. 3: shows average scatter regions during electron scattering at a selected scatter body.

The information relevant for designing the screening 7 is illustrated in FIG. 3 for a selected scatter material and for specific energy ranges between 2 MeV and 18 MeV. Shown in each case are the definitive average scatter angle Φ and the average deviation σ herefrom for electron scattering of the respective energy, which is represented as bars centered around the average scatter angle Φ. The average deviation σ corresponds here to the standard deviation, so that in the example illustrated here, assuming normally distributed scatter events, it is to be assumed that around 68% will be scattered in the average solid angle region defined by the average scatter angle Φ and the average deviation σ.

The knowledge of the average scatter angle ranges as a function of the kinetic energy of the incident electrons can be used to explicitly geometrically design and screen the x-ray device 1. The solid angle region Ω, which the screening 7 covers, corresponds to the sum of the average scatter angle ranges, of which the scatter centers lie in the edge region B of the beam limiting device 4 definitive for the electron scattering. The extent of the screening 7 can be greatly reduced by this method of construction.

A preferred method for manufacturing the x-ray device 1 described here comprises a method step in which a component, which in its finally installed state forms the beam limiting device 4, is introduced into the beam path of the electron beam E provided by the linear accelerator 2. The beam limiting device opening 5 is burned into the component via the electron beam E. To this end the current strength of the electron beam possibly provided by the linear accelerator 2 can be increased by comparison with the current strength created during regular operation. Since the number of electrons, because of the focused characteristics of the linear accelerator 2 in a central region of the electron beam E, is greatly increased and greatly decreases on the edge side, with a procedure of this type, an edge region B surrounding the beam limiting device opening 5 with the scattering characteristics described above remains. Edge-side beam areas of the electron beam E, in which the number of electrons is greatly reduced compared to the central region of the electron beam E, are thus scattered away from the target 3 in regular operation of the x-ray device 1 and in this way the extent of the focal spot on the target 3 is minimized.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

Although the invention has been illustrated and described in greater detail with reference to the preferred example embodiment, the invention is not restricted by this. Other variations and combinations can be derived herefrom by the person skilled in the art, without departing from the major ideas of the invention.

What is claimed is:

1. An x-ray device for creation of high-energy x-ray radiation, comprising:

a linear accelerator for creation of x-ray radiation, embodied to create an electron beam directed onto a target, kinetic energy per electron of the x-ray radiation amounting to at least 1 MeV; and a beam limiting device, arranged in a beam path of the electron beam between the linear accelerator and the target, including an edge region surrounding a beam limiting device opening, a thickness of a material of the edge region in a propagation direction of the accelerated electron beam emerging from the linear accelerator amounting to less than 10% of an average reach of electrons of created kinetic energy in the material of the edge region, the edge region of the beam limiting device forming a scattering body.

2. The x-ray device of claim 1, wherein at least the edge region of the beam limiting device includes graphite.

3. The x-ray device of claim 1, wherein the beam limiting device is coolable via a cooling device.

4. The x-ray device of claim 1, further comprising:

a collimator, arranged in a beam path of x-rays created by application of the beam to the target.

5. The x-ray device of claim 1, further comprising:

a vacuum housing, at least surrounding the linear accelerator, the beam limiting device and the target, the vacuum housing being provided at least in some regions with screening suitable for absorbing x-ray radiation caused by slowing down scattered electrons.

6. The x-ray device of claim 1, wherein the kinetic energy per electron in the electron beam created amounts to less than 20 MeV.

7. The x-ray device of claim 1, wherein at least the edge region of the beam limiting device is formed by at least one film.

8. The x-ray device of claim 2, wherein at least the edge region of the beam limiting device is formed by at least one film.

9. The x-ray device of claim 2, further comprising:

a collimator, arranged in a beam path of x-rays created by application of the beam to the target.

10. The x-ray device of claim 2, further comprising:

a vacuum housing, at least surrounding the linear accelerator, the beam limiting device and the target, the vacuum housing being provided at least in some regions with screening suitable for absorbing x-ray radiation caused by slowing down scattered electrons.

11. The x-ray device of claim 8, wherein the film includes a metal.

12. The x-ray device of claim 11, wherein the film includes at least partly titanium, stainless steel or copper or is coated with titanium, stainless steel or copper.

13. The x-ray device of claim 3, wherein the cooling device is a water cooling device.

14. The x-ray device of claim 5, wherein the regions provided with the screening, compared to regions of the vacuum housing without screening, exhibit an increased absorption for x-ray radiation.

15. The x-ray device of claim 5, wherein the regions provided with the screening lie exclusively within a solid angle region emanating from the beam limiting device and extending in the propagation direction of the electron beam.

16. The x-ray device of claim 14, wherein the regions provided with the screening lie exclusively within a solid angle region emanating from the beam limiting device and extending in a propagation direction of the electron beam.

17. The x-ray device of claim 15, wherein the solid angle region corresponds to an average solid angle region of the scattered electrons in the edge region of the beam limiting device.

18. The x-ray device of claim 7, wherein the film includes a metal.

19. The x-ray device of claim 18, wherein the film includes at least partly titanium, stainless steel or copper or is coated with titanium, stainless steel or copper.

20. The x-ray device of claim 10, wherein the regions provided with the screening, compared to regions of the vacuum housing without screening, exhibit an increased absorption for x-ray radiation.

21. A method for manufacturing an x-ray device for creation of high-energy x-ray radiation, the x-ray device including a linear accelerator for creation of x-ray radiation, embodied so as to create an electron beam directed onto a target, kinetic energy per electron of the electron beam amounting to at least 1 MeV, the method comprising:

arranging a component in a beam path of the electron beam, between the linear accelerator and the target, a material thickness of the component in a propagation direction of the electron beam amounting to less than 10% of an average reach of electrons of created kinetic energy in the material of the component; and inserting a beam limiting device opening into the component by the component having an electron beam created via application of the linear accelerator, an edge region surrounding the beam limiting device opening forming a scattering body.

* * * * *